US005566698A

United States Patent [19]

Yu

[11] Patent Number: 5,566,698

[45] Date of Patent: Oct. 22, 1996

[54] SAFE ACTUATING MECHANISM FOR AN AUTOMATIC UMBRELLA

[76] Inventor: Shu C. Yu, 425, Chung Hsing Road, Pin Chang City, Taoyuan, Taiwan

[21] Appl. No.: 557,560

[22] Filed: Nov. 14, 1995

[51] Int. Cl.[6] ..... A45B 25/14

[52] U.S. Cl. ..... 135/24; 135/25.4

[58] Field of Search ..... 135/22–24, 25.4, 135/25.41

[56] References Cited

U.S. PATENT DOCUMENTS

| | | | |
|---|---|---|---|
| 5,088,512 | 2/1992 | Chon et al. | 135/24 |
| 5,178,174 | 1/1993 | Wu | 135/22 |
| 5,390,686 | 2/1995 | Lin et al. | 135/24 |
| 5,441,065 | 8/1995 | Lin et al. | 135/24 |
| 5,492,140 | 2/1996 | Lin et al. | 135/22 X |

FOREIGN PATENT DOCUMENTS

| | | | |
|---|---|---|---|
| 2240038 | 7/1991 | United Kingdom | 135/24 |

*Primary Examiner*—Lanna Mai

[57] ABSTRACT

The invention relates to a safe actuating mechanism for an automatic umbrella, mainly including a security body arranged inside an umbrella handle, where the security body forms an actuating mechanism in combination with inner and outer tubes, a connecting rod, and a specially designed button so that the umbrella can be operated automatically under various spring forces.

1 Claim, 6 Drawing Sheets

SAFE ACTUATING MECHANISM FOR AN AUTOMATIC UMBRELLA

SUMMARY OF THE INVENTION

For providing users more convenience many umbrellas in the market are designed to be automatically operated, that is to say, they are capable of being opened or closed automatically. Although these operating means respectively have their unique features, they are commonly easy to be actuated unintentionally, resulting in annoyances. As an illustrative example, the U.S. Pat. No. 5,178,174 shows an automatic umbrella in which an operating mechanism is provided on the umbrella handle for opening and closing the umbrella in conjunction with a link and a button. The other parts of the umbrella, such as ribs, metal inner and outer tubes, and stretchers, are similar to those in most conventional umbrellas. Likewise, the automatic umbrella has also the drawback of being easily kindled.

Therefore, the primary object of the invention is to provide a safe actuating mechanism for an automatic umbrella in which an innovated structure is provided for governing the stretch and closure of an umbrella, eliminating the possibility of activating the automatic operating means of the umbrella by accident.

The structure and features of the invention will be described hereinafter in detail in conjunction with the accompanying drawings.

BRIEF DESCRIPTION OF THE ACCOMPANYING DRAWINGS

DETAILED DESCRIPTION OF THE PREFERRED EMBODIMENT

Figure 1:
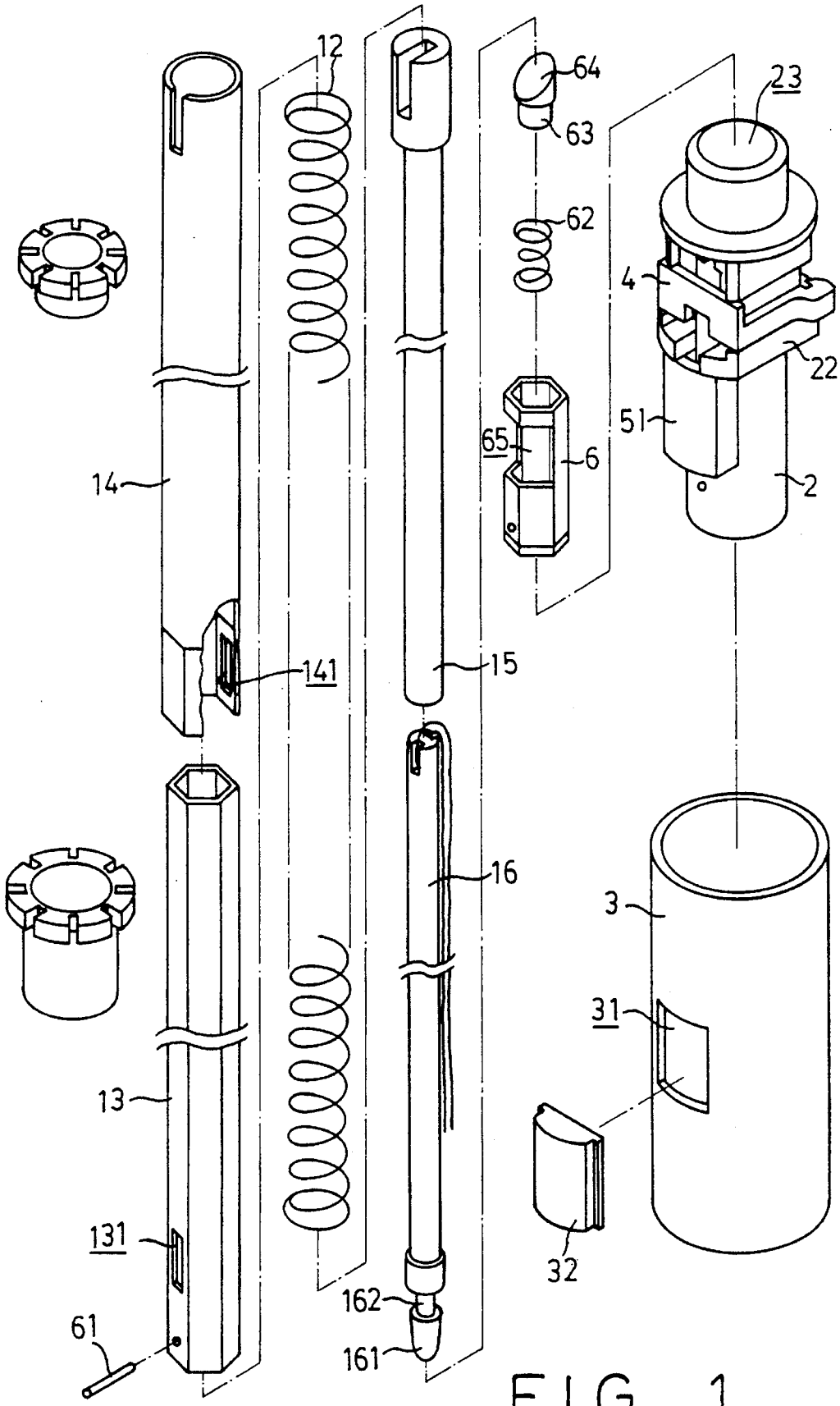
FIG. 1 is an exploded view of an embodiment of a safe actuating mechanism according to the invention.
Figure 2:
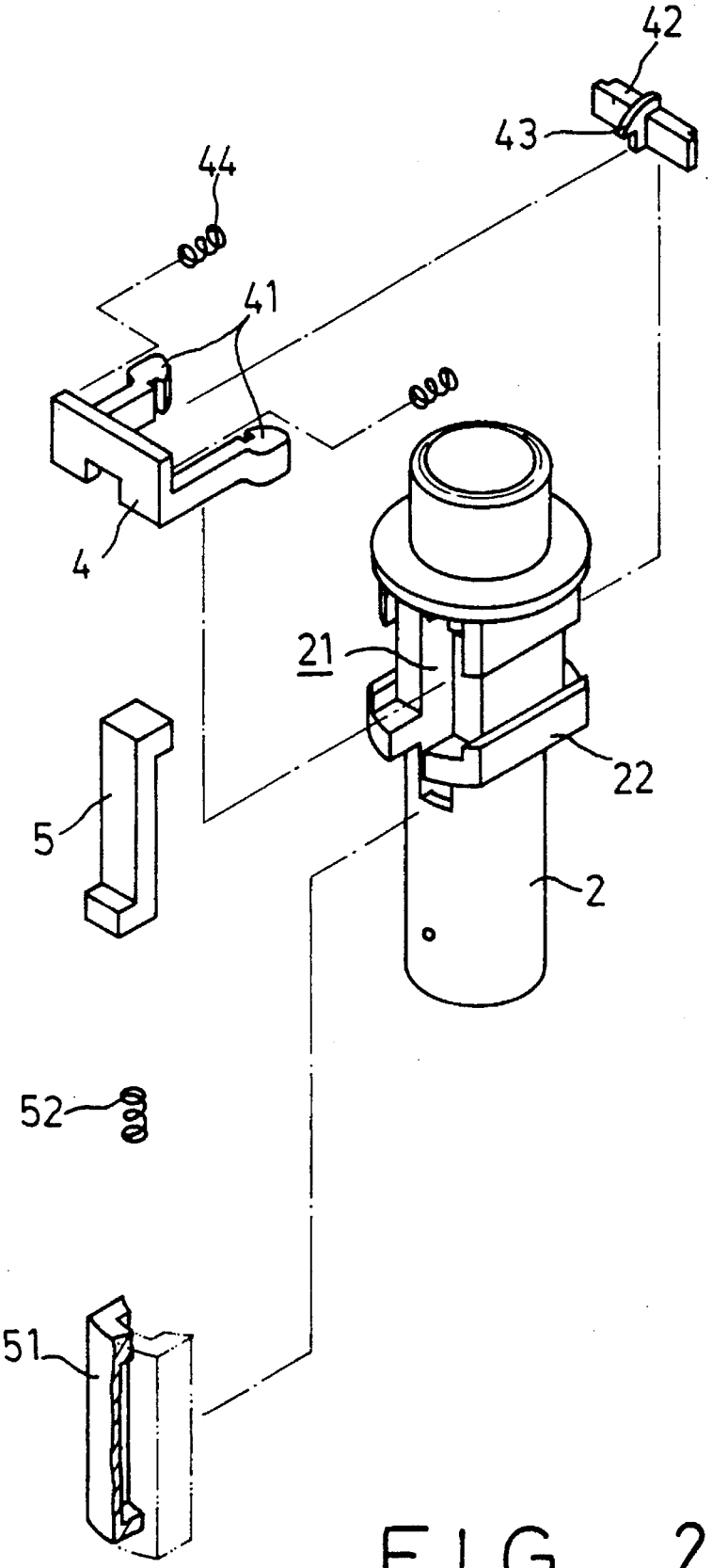
FIG. 2 is an exploded view of security means of the safe actuating mechanism shown in FIG. 1.
Figure 3:
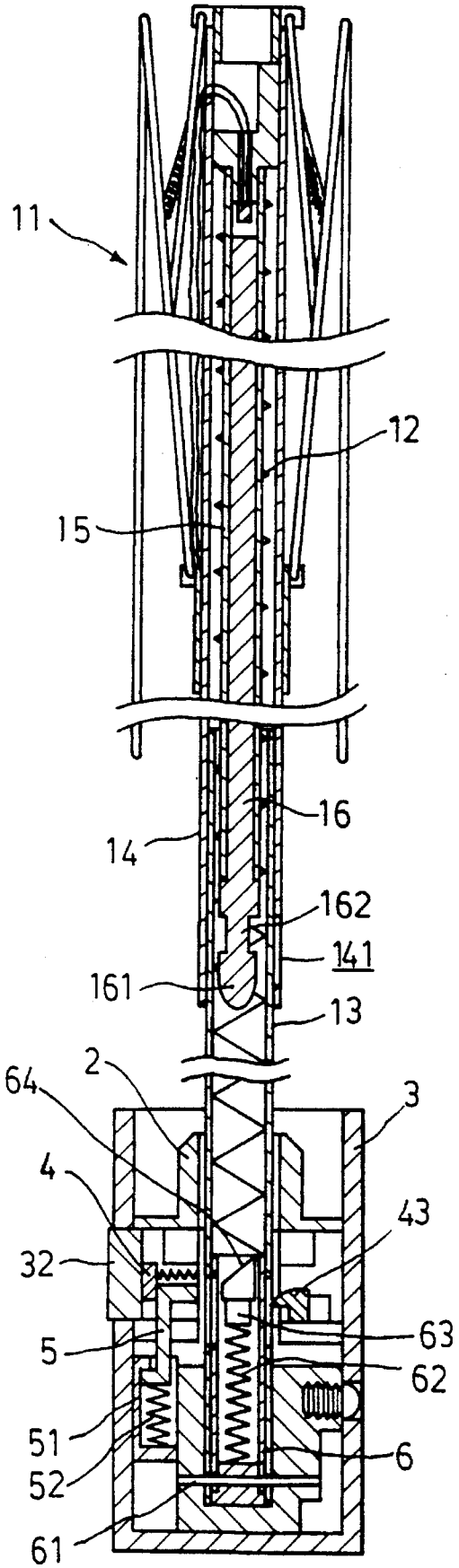
FIG. 3 is a cross sectional view in the axial direction for explaining the safe actuating mechanism of the invention.

FIGS. 1 through 3 are views for showing an embodiment of a safe actuating mechanism according to the invention. The configurations and functions of the umbrella stretchers (11), springs (12), inner tubes (13), outer tubes (14), sleeves (15), and central connecting rods (16) shown in these figures are similar to those of a conventional umbrella and thus they are not detailed here. The essential structure of a safe actuating mechanism according to the invention comprises a security body (2) arranged inside the handle (3). The security body (2) has a groove (21) and further is provided with a coupling seat on its outer surface for receiving a U-shaped coupling piece (4). The coupling piece (4) has a hooked portion (41) each at its two ends for grasping a bar (42). Hence, the coupling piece (4) can firmly cling to the security body (2). The bar (42) has a hooked projection (43) in its middle portion and springs (44) are disposed between the coupling piece (4) and the security body (2), which constantly biases the hooked projection (43) toward the groove (21). In the primary structure of the safe actuating mechanism there is further provided with a Z-shaped push lever (5), which extends its one end into a guide block (51) attached to one side of the security body (2) and the other end near the groove (21). A spring (52) is disposed beneath the bottom of the push lever (5) for keeping the push lever (5) moving upwards.

An inner tube (13) together with a tubular column (6) extends into the central hole (23) of the security body (2) and is secured therein by a pin (61). A connecting rod (61) has an upper end extending into a sleeve (15) and a lower end penetrating the central hole (23) of the security body (2). A spring (62) and a plunger (63) are arranged in the tubular column (6). On the top of the plunger (63) is a slant surface (64), which faces toward a hollow (65) on the wall of the tubular column (6).

An opening (31) is provided on the peripheral surface of the handle (3) for accommodating a button (32). The button (32) is supported on its inner surface by the coupling piece (4). Furthermore, the end of the connecting rod (16) is configured to have a spherical surface (161) and a reduced neck portion (162). The neck portion (162) is made of a plastic material so that it may be bent or deflected when a force is applied on the spherical end of the connecting rod (16).

The operation of an automatic umbrella equipped with a safe actuating mechanism is described as follows.

Figure 4:
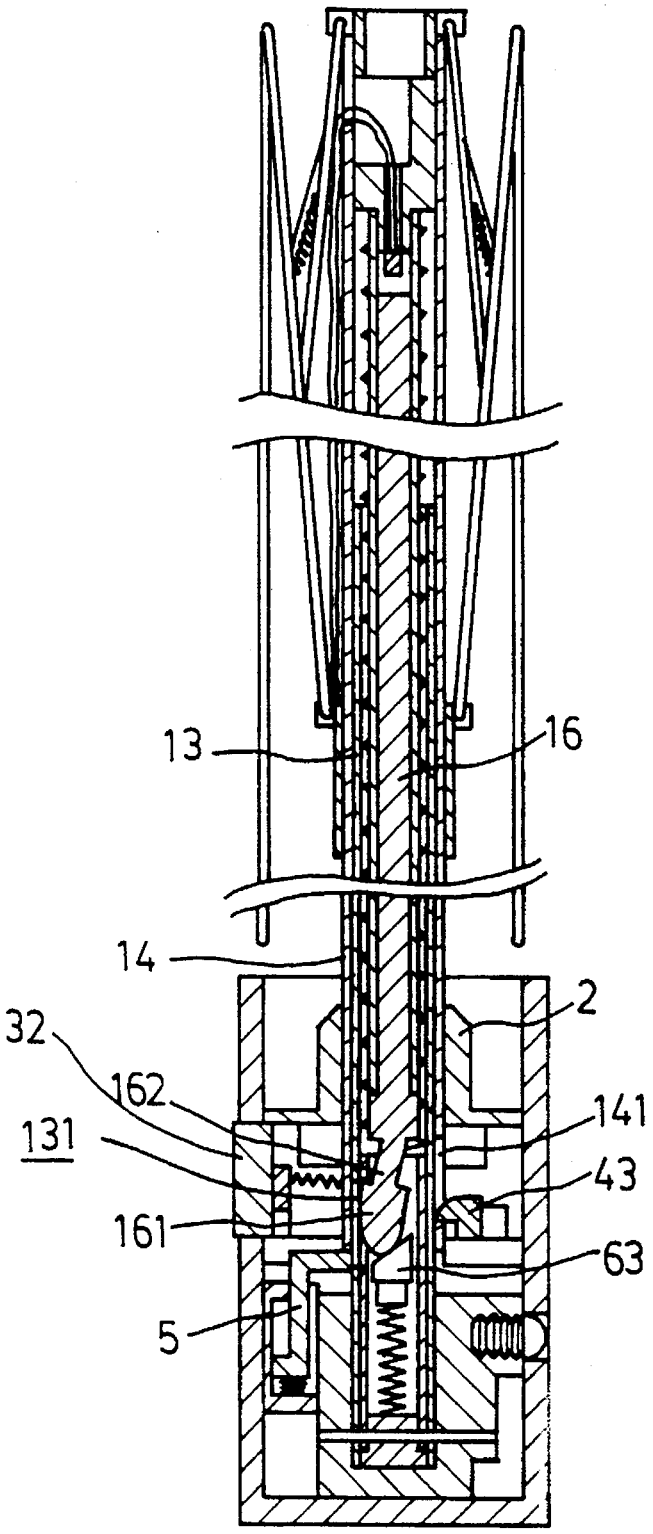
FIG. 4 is a cross sectional view in the axial direction for illustrating the safe actuating mechanism in a state in which the umbrella is collapsed.

To collapse the umbrella, push down the outer tube (14) first to make the lower end of the outer tube (14) get into the central hole (23) of the security body (2). At the same time, the Z-shaped push lever (5) is urged to move downwards as shown in FIG. 4. In addition, when the connecting rod (16) moves down and the spherical end (161) begins to contact with the plunger (63), the slant surface (64) deflects the spherical end (161), and finally the neck portion (162) falls into the hollow (65) of the tubular column (6) and an elongated slot (131) on the inner tube (13) and is fixed thereto. The outer tube (14), which has an opening (141) provided on the peripheral surface thereof to engage with the hooked projection (43) of the bar (42), is also releasably detained by the bar (42) at that position.

Figure 5:
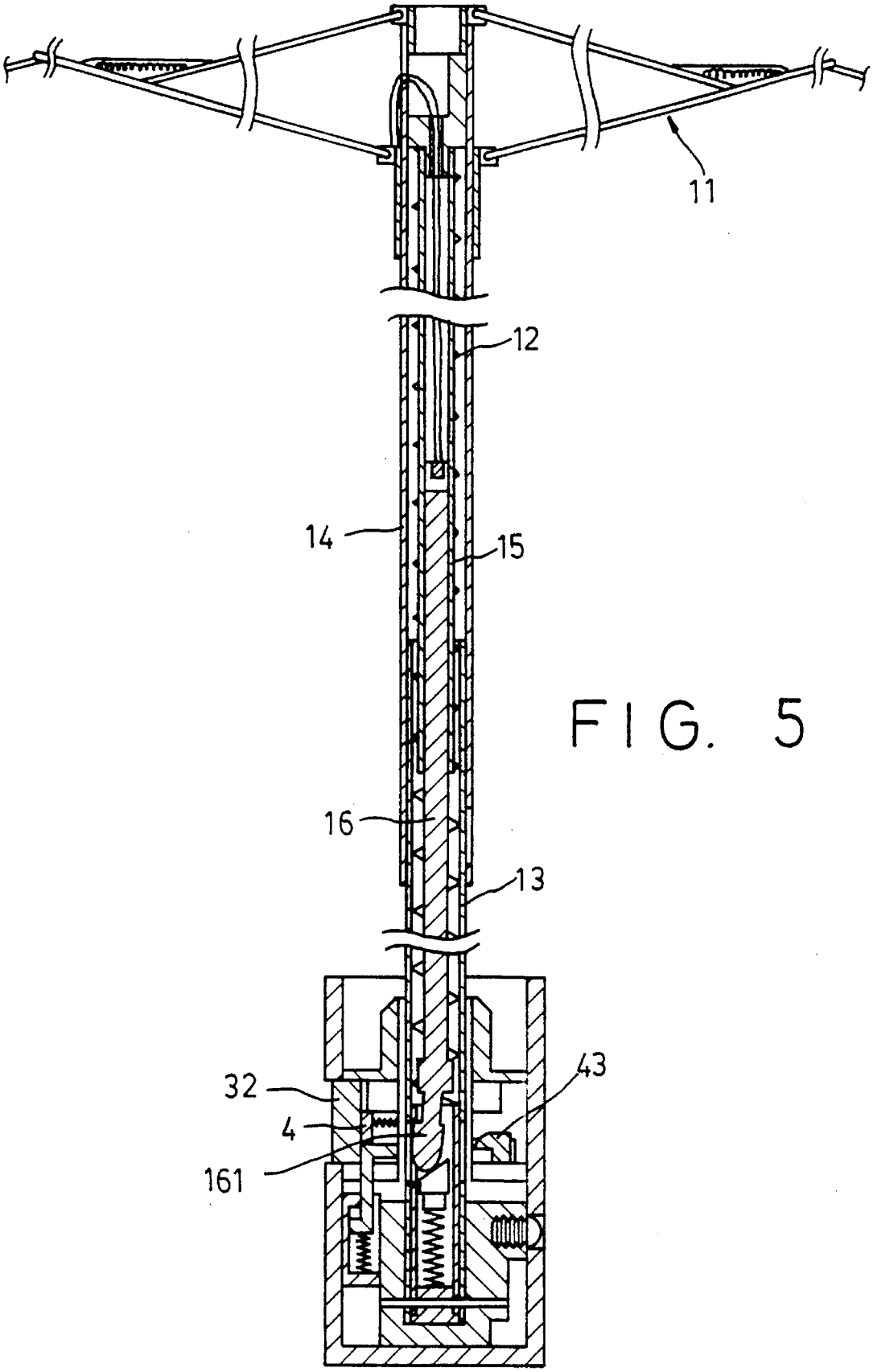
FIG. 5 is a cross sectional view in the axial direction for illustrating the stretch of an umbrella with the safe actuating mechanism.

When the button (32) is pressed down, the coupling piece (4) is driven to move inwards, resulting in the disengagement of the hooked projection (43) from the outer tube (14). Therefore, under the influence of spring forces, the outer tube (14) moves upward and the umbrella automatically stretches as shown in FIG. 5. At the moment, the connecting rod (16) still stays in its locked position because that its spherical end has not yet released. In addition, the outer tube (14) keeps on covering the elongated slot (131) and the hollow (65) of the tubular column (6) by its lower portion until the outer tube rises. Consequently, the arrangement can eliminate the possibility of inadvertently touching and releasing the spherical end (161) of the connecting rod (16).

Figure 6:
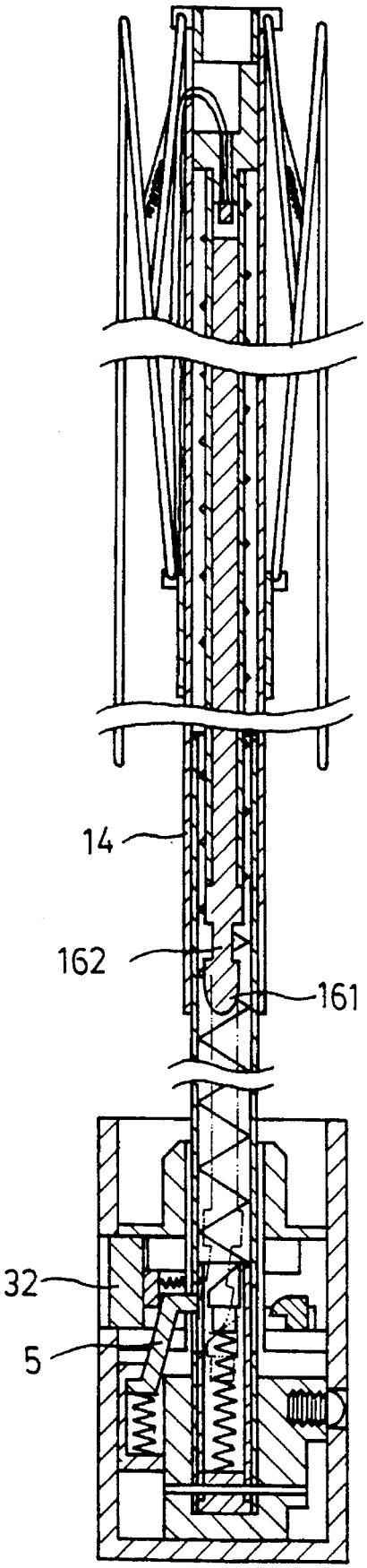
FIG. 6 is a cross sectional view in the axial direction for illustrating the closure of an umbrella with the safe actuating mechanism.

As shown in FIG. 6, when collapsing the umbrella is desired, push down the button again and the Z-shaped push lever (5) is impelled to move the spherical end (161) because the outer tube has risen at this moment. As soon as the neck portion (162) disengages from the hollow, the connecting rod (16) automatically moves up. Under a spring force as that in a conventional automatic umbrella, the umbrella can be collapsed.

What is claimed is:

1. A safe actuating mechanism for an automatic umbrella comprising:

a security body arranged inside an umbrella handle, the body having a groove and being provided with a coupling seat for receiving a coupling piece which has a hooked portion each at both ends to grasp a bar so that said coupling piece cling to said security body, said bar further having a hooked projection in its middle portion and springs being arranged between said coupling piece and said security body to constantly bias the hooked projection of said bar towards the groove of said security body in a way that said hooked projection is kept in a ready position to lock an outer tube;

a Z-shaped push lever of which one end extends into a guide block attached to one side of said security body, with a spring disposed beneath the bottom thereof to keep the push lever moving upwards and enable it to be moved inwards, and the other end reaches near said groove;

a connecting rod of which them lower end is a spherical end with a reduced neck portion near the end and the lower end extends into a central hole of said security body, and a tubular column disposed inside said security body;

said tubular columns further having a spring and a plunger provided therein, and said plunger having a slant surface on its top which faces toward a hollow of the tubular column so that when the neck portion, which is made of an elastically flexible material, touches the slant surface the lower end of said connecting rod will bend to engage with said tubular column and said inner tube.

* * * * *